US007293550B2

(12) United States Patent
Beardmore

(10) Patent No.: US 7,293,550 B2
(45) Date of Patent: Nov. 13, 2007

(54) FUEL INJECTOR ISOLATION SEAT

(75) Inventor: John M. Beardmore, Howell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 110 days.

(21) Appl. No.: 11/343,975

(22) Filed: Jan. 31, 2006

(65) Prior Publication Data

US 2007/0175451 A1 Aug. 2, 2007

(51) Int. Cl.
*F02M 55/02* (2006.01)

(52) U.S. Cl. ..... 123/470

(58) Field of Classification Search ..... 123/470
See application file for complete search history.

(56) References Cited

U.S. PATENT DOCUMENTS 3,038,456 A * 6/1962 Dreisin ..... 123/470
4,066,213 A * 1/1978 Stampe ..... 239/533.3
4,295,452 A * 10/1981 Lembke et al. ..... 123/470
4,519,371 A * 5/1985 Nagase et al. ..... 123/470
4,528,959 A * 7/1985 Hauser, Jr. ..... 123/470
5,244,180 A * 9/1993 Wakeman et al. ..... 251/129.16
5,697,554 A * 12/1997 Auwaerter et al. ..... 239/88
5,785,024 A * 7/1998 Takei et al. ..... 123/470
5,934,253 A * 8/1999 Kojima et al. ..... 123/470
6,009,856 A * 1/2000 Smith et al. ..... 123/470
6,178,950 B1 * 1/2001 Stockner et al. ..... 123/470
6,286,839 B1 * 9/2001 Mitsui et al. ..... 277/603
6,314,943 B1 * 11/2001 Burch et al. ..... 123/470
6,460,512 B1 * 10/2002 Serio ..... 123/470
6,543,421 B2 * 4/2003 Lorraine et al. ..... 123/470
6,640,784 B1 * 11/2003 Sims, Jr. ..... 123/470
6,805,103 B1 * 10/2004 Sumida et al. ..... 123/470
6,807,945 B2 * 10/2004 Reiter et al. ..... 123/470
6,840,226 B2 * 1/2005 Hans ..... 123/470
6,899,341 B2 * 5/2005 Neumaier ..... 277/647
7,104,257 B2 * 9/2006 Kawamoto et al. ..... 123/470

* cited by examiner

*Primary Examiner*—Thomas Moulis

(57) ABSTRACT

An isolation seat assembly for a fuel injector that is at least partially disposed within a stepped bore defined by a cylinder head, the stepped bore includes a land. The isolation seat assembly includes a cupped spring washer and an elastomeric ring member disposed between the cupped spring washer and the land. The isolation seat assembly operates to bias the fuel injector away from the land to substantially isolate the fuel injector from the head. The cupped spring washer and elastomeric ring member may be bonded to one another. Additionally, the isolation seat assembly may include a washer member between the elastomeric ring member and the land. The washer member operates to distribute axial forces from the fuel injector to the land. At least a portion of the washer member may be crimped into engagement with the cupped spring washer, thereby capturing the elastomeric ring member therein between.

18 Claims, 1 Drawing Sheet

FUEL INJECTOR ISOLATION SEAT

TECHNICAL FIELD

The present invention relates to fuel delivery systems for internal combustion engines.

BACKGROUND OF THE INVENTION

Fuel delivery systems for internal combustion engines are available in many different varieties, one of the more common of which is the port fuel injection system. The port fuel injection system utilizes a plurality of fuel injectors each of which delivers a predetermined amount of fuel to the inlet port of an associated combustion chamber. In such systems, the fuel injectors are mounted in sockets or injector bosses of a manifold or fuel rail, which operates to communicate fuel to each of the injectors.

Recent advances in fuel delivery and combustion research has allowed direct injection, or DI, fuel delivery systems to increase in popularity. The DI fuel delivery system provides a fuel injector within a cylinder head of the internal combustion engine. The DI fuel injector operates to inject a predetermined amount of fuel directly into the combustion chamber. Since gas pressures within the combustion chamber are orders of magnitude greater than that of the intake port, the DI fuel rail and fuel injector operate at a much higher fuel pressure than similar components within the port fuel injection system. The DI fuel delivery system enables higher peak power levels, improved fuel economy, and lower emissions. These beneficial aspects of the DI fuel delivery system are a result of the precise metering of the fuel injected into the combustion chamber as well as improved intake airflow into the combustion chamber.

The electromagnetic fuel injectors of the DI fuel delivery system deliver fuel to the combustion chamber in metered pulses, which are timed to control the amount of fuel delivered and to coordinate such delivery with specific points of the operational cycle of the engine. The sequential energization of the fuel injectors may operate to induce pressure pulsations within the fuel rail, which may produce noise-emitting vibrations. The transmission of vibrational energy generated within the DI fuel delivery system to the engine structure may follow two paths; from the fuel injector to the cylinder head and from the fuel rail to the respective attachment point, which is typically the cylinder head.

SUMMARY OF THE INVENTION

Accordingly, the isolated fuel delivery system of the present invention reduces the transmission of noise producing, high frequency vibrations from the fuel injector to the engine.

Provided is an isolated fuel delivery system adapted for combination with a cylinder head. The head defines a generally stepped injector bore having a land. The isolated fuel delivery system includes a fuel rail and a fuel injector, such as a direct injection fuel injector. The fuel rail operates to provide pressurized fuel to the fuel injector. The fuel injector is at least partially disposed within the generally stepped injector bore. The system also provides a fuel injector isolation seat assembly disposed between the fuel injector and the land. The fuel injector isolation seat assembly includes a spring washer, such as a Belleville-type washer, and an elastomeric ring member. The fuel injector isolation seat assembly operates to bias the fuel injector away from the land to substantially isolate the fuel injector from the head.

The spring washer and the elastomeric ring member may be bonded together. Additionally, the elastomeric ring member may be sufficiently configured to sealingly engage the fuel injector. The isolated fuel delivery system may further include a generally annular combustion seal. The fuel injector may include a body portion having a tip portion extending generally axially therefrom, with the tip portion being sufficiently configured to receive the generally annular combustion seal. A secondary seal, having a generally frustoconical shape and formed from an elastomeric material, may be provided. The secondary seal is mounted with respect to the tip portion between the body portion and the generally annular combustion seal. The secondary seal operates to sealingly engage the generally stepped injector bore and the tip portion.

A washer member may be provided between the spring washer and the elastomeric ring member, in combination, and the land. Additionally, at least a portion of the washer member may be crimped into engagement with the spring washer of the fuel injector isolation seat assembly to capture the elastomeric ring member therebetween.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
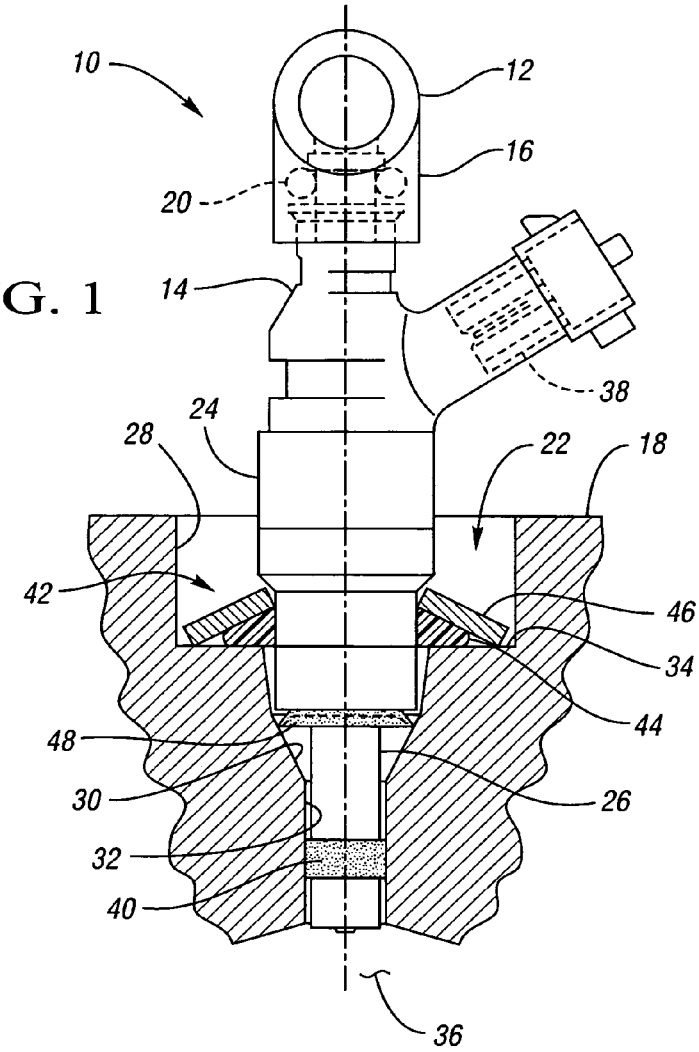
FIG. 1 is a partial cross sectional side elevational view of an isolated fuel delivery system having a fuel injector isolation seat assembly and a secondary seal consistent with the present invention.

Referring to the drawings wherein like reference numbers represent like components throughout the several figures, there is shown in FIG. 1 an isolated fuel delivery system 10 having a fuel rail 12 and a direct injection fuel injector 14. The fuel rail 12 operates as a conduit to communicate pressurized fuel to the fuel injector 14. In the preferred embodiment, the fuel rail 12 will be isolated at its point of attachment. Although only one fuel injector 14 is shown in FIG. 1, those skilled in the art will recognize that the fuel rail 12 may operate as a manifold to provide multiple fuel injectors 14 with pressurized fuel. A fuel injector boss 16 operates to retain one end of the fuel injector 14 with respect to the fuel rail 12, while another end of the fuel injector 14 is disposed within a cylinder head 18 of an engine, not shown. The fuel injector 14 includes an injector seal 20, which operates to contain pressurized fuel within the fuel rail 12.

The cylinder head 18 defines a generally stepped injector bore 22 that is sufficiently configured to receive at least a portion of the fuel injector 14. In the preferred embodiment, the fuel rail 12 will maintain the fuel injector 12 in relation to the cylinder head 18. The fuel injector 14 includes a body portion 24 having a tip portion 26 extending axially therefrom. The injector bore 22 includes a generally cylindrical first bore portion 28, a two-stage tapering bore portion 30, and a generally cylindrical second bore portion 32. A circumferential land 34 is provided within the injector bore 22, between the first bore portion 28 and the tapering bore portion 30. More specifically, the second bore portion 32 is configured such that the fuel injector tip 26 can pass though the head 18 to communicate with a combustion chamber 36.

The fuel injector 14 includes an electrical connector 38 to operatively connect the fuel injector 14 to an external source of electrical potential, such as an electronic control unit, not shown. The fuel injector 14 operates to deliver a predetermined amount of fuel, at a specific point in the engine cycle, directly to the combustion chamber 36 to support combustion therein. A generally annular combustion seal 40 is provided about the tip portion 26 and sealingly engages the second bore portion 32 to disallow pressurized gases within the combustion chamber 38 from traversing the injector bore 22. In the preferred embodiment, the combustion seal 40 is formed from polytetrafluoroethylene (PTFE). However, those skilled in the art will recognize that other materials that possess similar heat and chemical resistance may be used. The combustion seal 40 relies, in part, on a carbon dam to effectively seal the injector bore. The carbon dam is formed when typical or normal products of combustion, specifically carbon-based compounds, pack around the combustion seal 40 during operation of the engine.

The circumferential land 34 is provided within the injector bore 22 as a means to locate or index the fuel injector 14 within the cylinder head 18. Disposed between the land 34 and the fuel injector 14 is a fuel injector isolation seat assembly 42. The isolation seat assembly 42 includes an elastomeric ring member 44 and a washer having a spring characteristic such as a cupped spring washer or Belleville-type washer 46. The ring member 44 is sufficiently configured to sealingly engage the tip portion 26 and is preferably formed from a silicone-based material having a durometer value of between 50 and 60 on the Shore-A scale. Silicone-based materials typically possess favorable isolation characteristics over a wide range of temperatures. These characteristics may include; low damping, low compression set, high durability, and high chemical resistive properties. Those skilled in the art will recognize other materials may be used to form the ring member 44 while remaining within the scope of that which is claimed. Additionally, the ring member 44 may be formed from a viscoelastic material if a measure of damping is desired.

The Belleville-type washer 46 is preferably formed from steel and has a slight conical shape thereby giving the Belleville-type washer 46 a spring-like characteristic. Those skilled in the art will recognize that other materials may be used to form the Belleville-type washer 46, such as steel, aluminum, composites, etc while remaining within the scope of that which is claimed. Additionally, the Belleville-type washer 46 may be bonded to the ring member 44 using adhesives known in the art.

In operation, the Belleville-type washer 46 operates to bias the fuel injector 14 out of contact with the land 34. By isolating the fuel injector 14 from the cylinder head 18 and more specifically the land 34, the vibratory impulses of the fuel injector 14 will be substantially isolated from the cylinder head 18. Multiple Belleville-type washers 46 may be employed within the isolation seat assembly 42 to derive unique load-deflection characteristics for the isolation seat assembly 42. For example, stacking multiple Belleville-type washers 46 in the same direction, i.e. "nesting", will add additional spring rate in parallel, thereby creating a stiffer isolation seat assembly 42 for a given deflection. Alternately, stacking multiple Belleville-type washers 46 in alternating directions is similar to adding the springs in series such that a lower spring constant and greater deflection of the isolation seat assembly 42 is achieved.

As the fuel pressure within the fuel rail 12 increases with engine load, the need to isolate the fuel delivery system 10 becomes less important as various other sounds emitted by the powertrain are greater than those emanating from the fuel delivery system 10. Additionally, it is desirable to limit the axial movement of the fuel injector 14 within the injector bore 22 for operating regions where isolation of the fuel system 10 is not required. The stiffness or spring rate of the isolation seat assembly 42 can be chosen such that the isolation seat assembly 42 will "ground" the fuel injector 14 to the land 34 under high engine load, high fuel pressure operating conditions, thereby limiting the axial motion of the fuel injector 14 within the injector bore 22.

A secondary seal 48 may be incorporated into the present invention. The secondary seal 48 is sufficiently configured to sealingly engage the tip portion 26 of the fuel injector 14 and the tapering bore portion 30 of the injector bore 22. The secondary seal 48 is generally frusto-conical in shape and is formed from an elastomeric material. The secondary seal 48 and the ring member 44 each serve to limit the passage of gases that may have traversed the combustion seal 40. Additionally, the secondary seal 48 and the ring member 44 working separately or in concert, function to decrease the pressure differential across the combustion seal 40 thereby stabilizing the combustion seal 40 and allowing it to fully develop an annular seal against the second bore portion 32. The secondary seal 48 and the ring member 44 may be formed integrally.

Figure 2A:
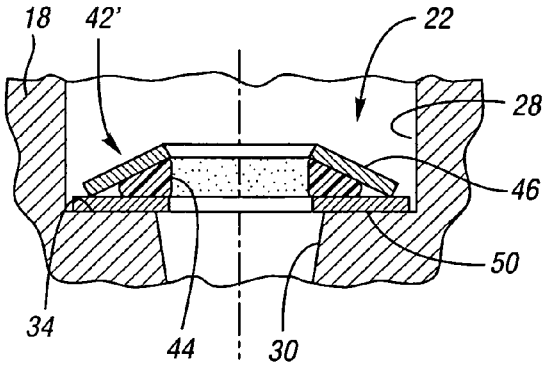
FIG. 2*a* is a cross sectional side elevational view of an alternate embodiment of the isolation seat assembly shown in FIG. 1.
Figure 2B:
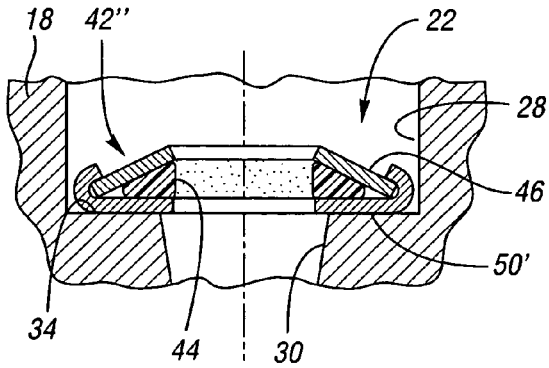
FIG. 2*b* is a cross sectional side elevational view of an alternate embodiment of the isolation seat assembly shown in FIG. 2*a*.

An alternate embodiment of the isolation seat assembly 42, shown in FIG. 1, is illustrated in FIG. 2*a* and is designated as 42'. The isolation seat assembly 42' includes a shim or washer 50 disposed between the ring member 44 and the land 34. The washer 50 is preferably formed from a hardened metal, such as steel, and operates to evenly distribute axial thrust loads of the fuel injector 14 to the land 34. Additionally, the washer 50 may serve to reduce or eliminate fretting wear or damage to the land 34 as a result of relative movement between the Belleville-type washer 46, which is formed from a hard material, and the land 34, which is typically formed from a relatively softer material such as aluminum, FIG. 2*b* illustrates an isolation seat assembly 42", which is similar to the isolation seat assembly 42' shown in FIG. 2*a*. The isolation seat assembly 42" includes a washer 50'. The outer periphery of the washer 50' is crimped, rolled, or otherwise formed over the outer periphery of the Belleville-type washer 46 securing the ring member therein between.

In addition to providing a measure of vibratory isolation to the isolated fuel delivery system 10, the isolation seat assemblies 42, 42', 42" operate to limit the heat transfer between the cylinder head 18 and the fuel within the isolated fuel delivery system 10. The isolation seat assemblies 42, 42', and 42" can compensate for slight misalignment, and aid in the centering, of the fuel injector 14 within the injector bore 22.

While the best modes for carrying out the invention have been described in detail, those familiar with the art to which this invention relates will recognize various alternative designs and embodiments for practicing the invention within the scope of the appended claims.

The invention claimed is:

1. An isolatable fuel delivery system adapted for combination with a cylinder head defining a generally stepped injector bore having a land, the isolatable fuel delivery system comprising:

a fuel rail;

a fuel injector;

wherein said fuel rail is operable to provide pressurized fuel to said fuel injector;

wherein said fuel injector is at least partially disposable within the generally stepped injector bore;

a fuel injector isolation seat assembly, said fuel injector isolation seat assembly being operatively disposable between said fuel injector and the land;

wherein said fuel injector isolation seat assembly includes a spring washer and an elastomeric ring member; and wherein said fuel injector isolation seat assembly is operable to bias said fuel injector away from the land to substantially isolate said fuel injector from the head.

2. The isolatable fuel delivery system of claim 1, wherein said fuel injector is a direct injection type fuel injector.

3. The isolatable fuel delivery system of claim 1, wherein said spring washer is bonded to said elastomeric ring member.

4. The isolatable fuel delivery system of claim 1, wherein said elastomeric ring member is sufficiently configured to sealingly engage said fuel injector.

5. The isolatable fuel delivery system of claim 1, further comprising:

a generally annular combustion seal;

wherein said fuel injector includes a body portion having a tip portion extending generally axially therefrom;

wherein said tip portion is sufficiently configured to receive said generally annular combustion seal;

a secondary seal mounted with respect to said tip portion between said body portion and said generally annular combustion seal; and wherein said secondary seal sealingly engages the generally stepped injector bore and said tip portion.

6. The isolatable fuel delivery system of claim 5, wherein said secondary seal has a generally frusto-conical shape.

7. The isolatable fuel delivery system of claim 5, wherein said secondary seal is formed from an elastomeric material.

8. The isolatable fuel delivery system of claim 1, wherein a washer member is provided between said spring washer and said elastomeric ring member in combination and the land.

9. The isolated fuel delivery system of claim 8, wherein at least a portion of said washer member is crimped into engagement with said spring washer of said fuel injector isolation seat assembly to capture said elastomeric ring member therebetween.

10. An isolation seat assembly for a fuel injector that is at least partially disposed within a stepped bore defined by a cylinder head, the stepped bore including a land, the isolation seal comprising:

a spring washer;

an elastomeric ring member disposed between said spring washer and the land; and wherein said spring washer and said elastomeric ring member are operable to bias the fuel injector away from the land to substantially isolate the fuel injector from the head.

11. The isolation seat assembly of claim 10, wherein said spring washer is bonded to said elastomeric ring member.

12. The isolation seat assembly of claim 10, wherein a washer member is provided between said spring washer and said elastomeric ring member in combination and the land, said washer member being operable to distribute axial forces from the fuel injector to the land.

13. The isolation seat assembly of claim 12, wherein at least a portion of said washer member is crimped into engagement with said spring washer, thereby capturing said elastomeric ring member therebetween.

14. The isolation seat assembly of claim 10, wherein said elastomeric ring member is sufficiently configured to sealingly engage the fuel injector.

15. An isolated direct injection fuel delivery system comprising:

a fuel rail;

a direct injection fuel injector;

wherein said fuel rail is operable to provide pressurized fuel to said direct injection fuel injector;

wherein said direct injection fuel injector is at least partially disposed within a generally stepped injector bore, said generally stepped injector bore being defined by a cylinder head;

wherein said generally stepped injector bore includes a land;

a fuel injector isolation seat assembly, said fuel injector isolation seat assembly being operatively disposed between said direct injection fuel injector and said land;

wherein said fuel injector isolation seat assembly includes a cupped spring washer and an elastomeric ring member; and wherein said fuel injector isolation seat assembly is operable to bias said direct injection fuel injector away from said land to substantially isolate said direct injection fuel injector from said head.

16. The isolated direct injection fuel delivery system of claim 15, further comprising:

a generally annular combustion seal;

wherein said direct injection fuel injector includes a body portion having a tip portion extending generally axially therefrom;

wherein said tip portion is sufficiently configured to receive said generally annular combustion seal;

a secondary seal having a generally frusto-conical shape, said secondary seal being mounted with respect to said tip portion between said body portion and said generally annular combustion seal; and wherein said secondary seal sealingly engages said generally stepped injector bore and said tip portion.

17. The isolated direct injection fuel delivery system of claim 15, wherein a washer member is provided between said elastomeric ring member and said land.

18. The isolated direct injection fuel delivery system of claim 15, wherein at least a portion of said washer member is crimped into engagement with said cupped spring washer, thereby capturing said elastomeric ring member therein between.

* * * * *